US005395120A

United States Patent [19]

Malek

[11] Patent Number: 5,395,120

[45] Date of Patent: * Mar. 7, 1995

[54] METHOD AND APPARATUS OF PLAYING A CASINO GAME SIMULTANEOUSLY AGAINST THE DEALER AND OTHER PLAYERS

[76] Inventor: Mehrdad M. Malek, 1306 Daviswood Dr., McLean, Va. 22102

[ * ] Notice: The portion of the term of this patent subsequent to Nov. 30, 2010 has been disclaimed.

[21] Appl. No.: 201,205

[22] Filed: Aug. 24, 1994

Related U.S. Application Data

[63] Continuation-in-part of Ser. No. 80,871, Jun. 24, 1993, Pat. No. 5,328,189, which is a continuation-in-part of Ser. No. 16,308, Feb. 11, 1993, Pat. No. 5,265,882.

[51] Int. Cl.[6] ..... A63F 1/00

[52] U.S. Cl. ..... 273/292; 273/309

[58] Field of Search ..... 273/292, 274, 309, 85 CP

[56] References Cited

U.S. PATENT DOCUMENTS

| | | | |
|---|---|---|---|
| 5,013,049 | 5/1991 | Tomaszewski | 273/292 |
| 5,042,818 | 8/1991 | Weingardt | 273/292 |
| 5,154,429 | 10/1992 | Le Vasseur | 273/292 |
| 5,224,706 | 7/1993 | Bridgeman et al. | 273/85 CP |
| 5,265,882 | 11/1993 | Malek | 273/292 |
| 5,294,128 | 3/1994 | Marquez | 273/292 |

OTHER PUBLICATIONS

WIN magazine "Asian Poker" by Linya Quan, Apr. 1992 pp. 39,40,70.

Scarne's Encyclopedia Of Games by John Scarne, Harper & Row, Publishers, pp. 39, 1973.

*Primary Examiner*—Benjamin H. Layno

*Attorney, Agent, or Firm*—Parkhurst, Wendel & Rossi

[57] ABSTRACT

A method and apparatus for playing a mixture of modified Draw Poker and Twenty-One wherein a player can simultaneously play Poker against the dealer and Twenty-One against other players. The players place one bet against the Casino to play Draw Poker against the dealer, and a second bet against other players to play Twenty-One against the other players.

19 Claims, 3 Drawing Sheets

METHOD AND APPARATUS OF PLAYING A CASINO GAME SIMULTANEOUSLY AGAINST THE DEALER AND OTHER PLAYERS

CROSS REFERENCE TO RELATED APPLICATIONS

This application is a continuation-in-part of application Ser. No. 08/080,871, filed Jun. 24, 1993, and now U.S. Pat. No. 5,328,189 issued Jul. 12, 1994, which in turn is a continuation in part of application Ser. No. 08/016,308, filed Feb. 11, 1993, now U.S. Pat. No. 5,265,882, issued Nov. 30, 1993.

BACKGROUND OF THE INVENTION

This invention relates to a card game, in particular to a card game suitable for use in casinos, and to a specifically designed table for playing the game. Specifically, this invention relates to a method of and apparatus for playing a casino game simultaneously against a dealer and other players. More specifically, this invention relates to a method of and an apparatus for playing a mixture of Draw Poker and one of Twenty-One and Baccarat wherein a player can simultaneously play Draw Poker against a dealer and one of Twenty-One and Baccarat against other players.

There are many card games which can be used for gambling purposes, but these games are played only against the casino/bank. Also, each card game is usually played individually and it is rare to play more than one type of gambling game at any given time. U.S. Pat. No. 5,154,429 discloses a method of playing multiple action blackjack, but the play is limited to each player versus the dealer, who represents the casino or bank, and the play is limited solely to blackjack. Other casino games are disclosed in U.S. Pat. Nos. 4,651,997; 4,659,087; 4,836,553; 5,013,049; 5,098,107; 5,141,234; and 5,174,579.

There is also another casino game known as Pai-Gow Poker (also known as Asian poker). In this game each player plays against the bank (Casino) and each receives seven cards after placing their bets against the bank. Then each player picks up his cards and sets them in two hands consisting of a two card set (one set having five cards, the other set having two cards) according to the rules of Draw Poker. Both hands must be winners against the Casino in order to win the game against the Casino. If one hand wins and the other hand loses it will be a push and the bet will stay for the next round of play.

However, heretofore a card game has not been proposed wherein the player challenges not only the dealer but other players, and also the player can play Draw Poker against the dealer and Twenty-One against other players simultaneously, thus significantly increasing the odds of winning.

SUMMARY OF THE INVENTION

It is an object of the present invention to provide a gambling game wherein a player simultaneously plays and bets against a dealer and other players. More specifically, it is an object of the present invention to provide a gambling game which is a mixture of Draw Poker and one of Twenty-One and Baccarat, wherein the player can simultaneously play Draw Poker against the Dealer and one of Twenty-One and Baccarat against other players.

A preferred embodiment of the present invention relates to a method of simultaneously playing Draw Poker against a dealer and Twenty-One against other players, comprising the steps of:

a) at least two players making a wager to participate against each other in Twenty-One;
b) the dealer dealing five cards to each player and to the dealer;
c) at least said at least two players making a separate wager to participate against the dealer in Draw Poker;
d) the dealer dealing two additional cards to each player making said separate wager;
e) each player and the dealer assembling a Poker hand from five of their seven cards which provide the strongest possible Poker hand;
f) each of said at least two players assembling a Twenty-One hand from the remaining two cards of their seven cards;
g) the dealer comparing his Poker hand to that of each player to settle each wager between the dealer and each player; and
h) the dealer comparing the Twenty-One hand of each of said at least two players to settle the wager between said at least two players.

The present invention also relates to an apparatus for playing a mixture of Draw Poker and Twenty-One wherein a player simultaneously plays Draw Poker against a dealer and Twenty-One against other players, said apparatus comprising:

a table having an upper playing surface;
a dealer playing station at a first position on said playing surface;
a plurality of player playing stations at spaced positions on the playing surface and opposed to said dealer playing station, each of said player playing stations comprising a first horizontal row of two boxes, a second horizontal row of five boxes and a casino betting area positioned proximate said boxes; and
a player betting area positioned between said dealer playing station and the player playing stations.

These and other objects of the present invention will be better understood after reviewing the following detailed description taken in conjunction with the attached drawings.

DETAILED DESCRIPTION OF THE PREFERRED EMBODIMENTS

Figure 1A:
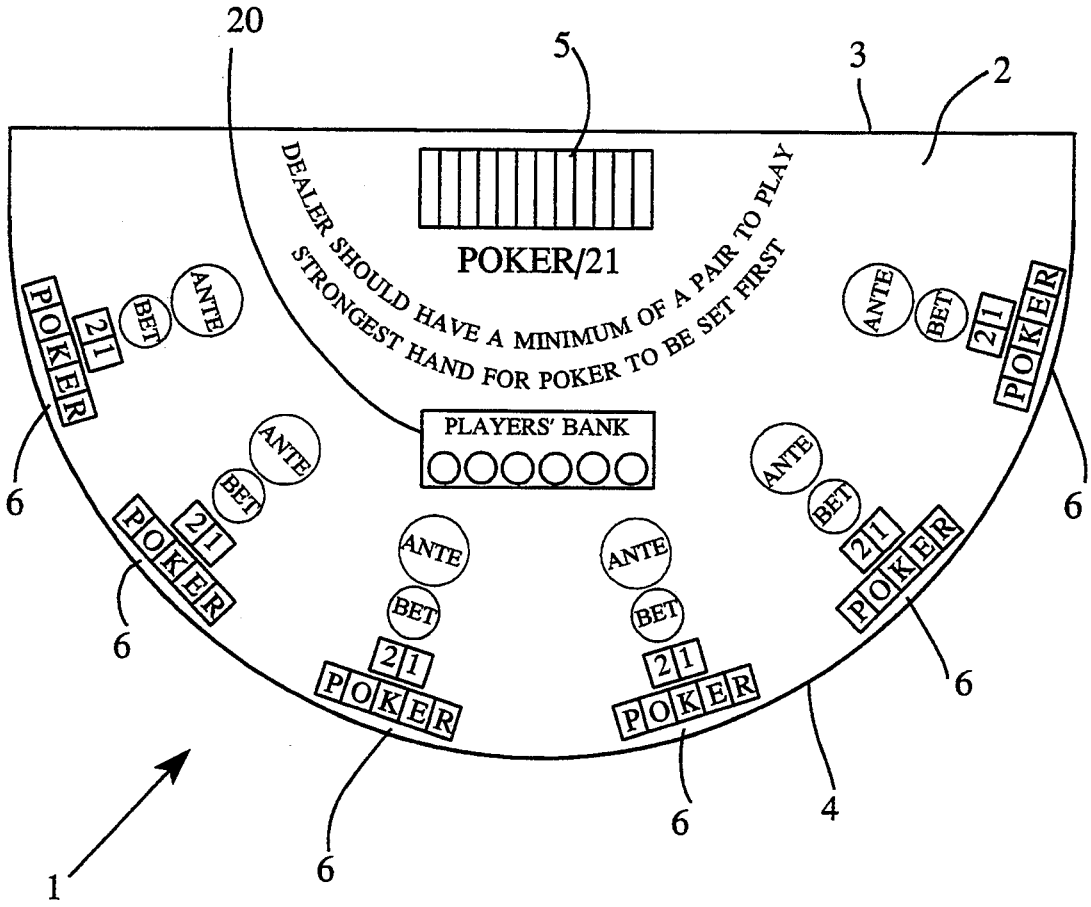
FIG. 1A shows a preferred layout of the apparatus of the present invention which is used in connection with the method of the present invention.

FIG. 1A shows a preferred set-up for the apparatus of the present invention. More specifically FIG. 1A shows a preferred embodiment of the apparatus of the present invention, which includes a table 1 having an upper playing surface 2 formed substantially in the shape of a semicircle. The surface 2 has a substantially linear side 3 along the diameter of the semicircle and a curved side 4 along the circumference of the semicircle. A dealer playing station 5 is arranged substantially midway along the diameter of the semicircular playing surface. Six player playing stations 6 are arranged along the circumference of the semicircular playing surface and are spaced an equal distance apart. It is in the player playing station where each player places his bet against the dealer, who represents the Casino, and also arranges his cards to be compared to those of the dealer. Also shown in FIG. 1A is a players' bank area 20 where each player can place bets against other players.

Figure 1B:
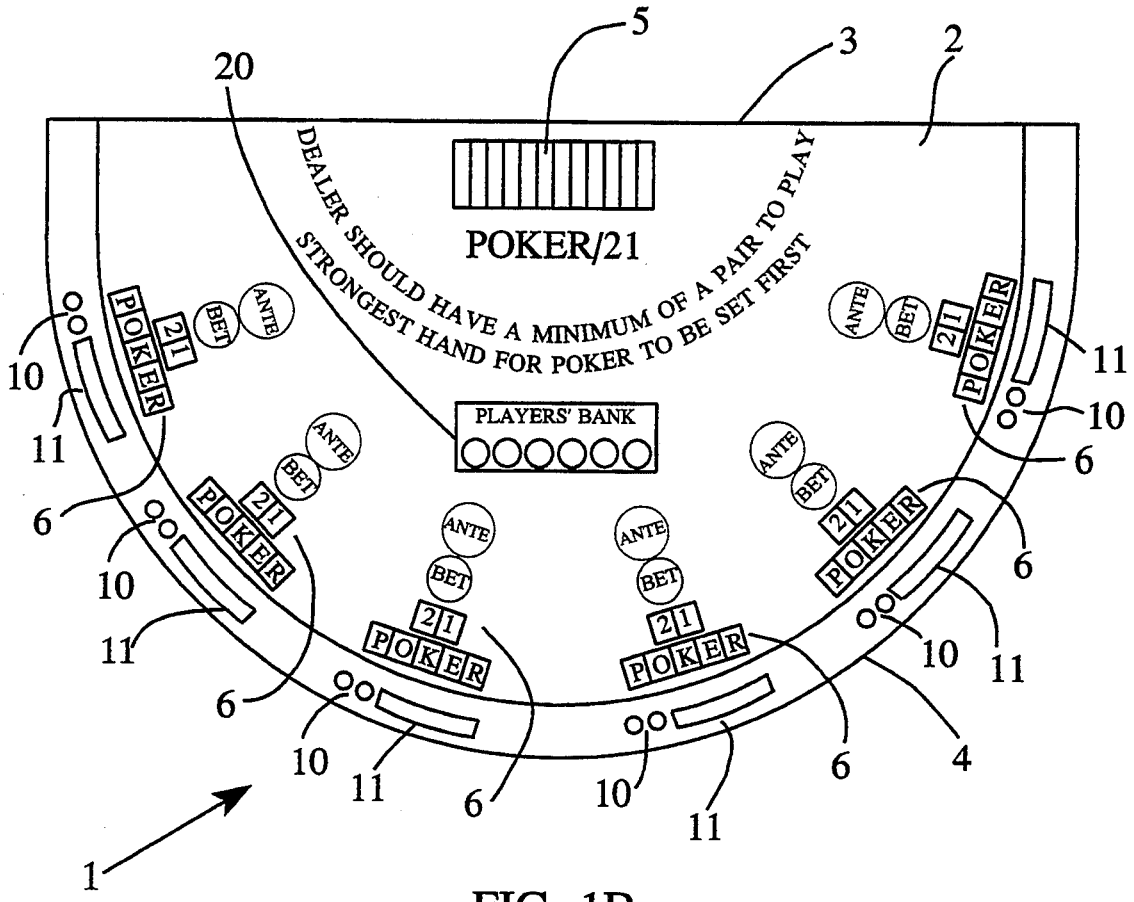
FIG. 1B shows a modified version of the apparatus of FIG. 1A.

FIG. 1B shows a modified version of the apparatus of FIG. 1A, which includes openings 10 through the table 1 and individual chip trays 11 for each player. The openings can be used to hold drinks, ash trays, and the like.

Figure 2:
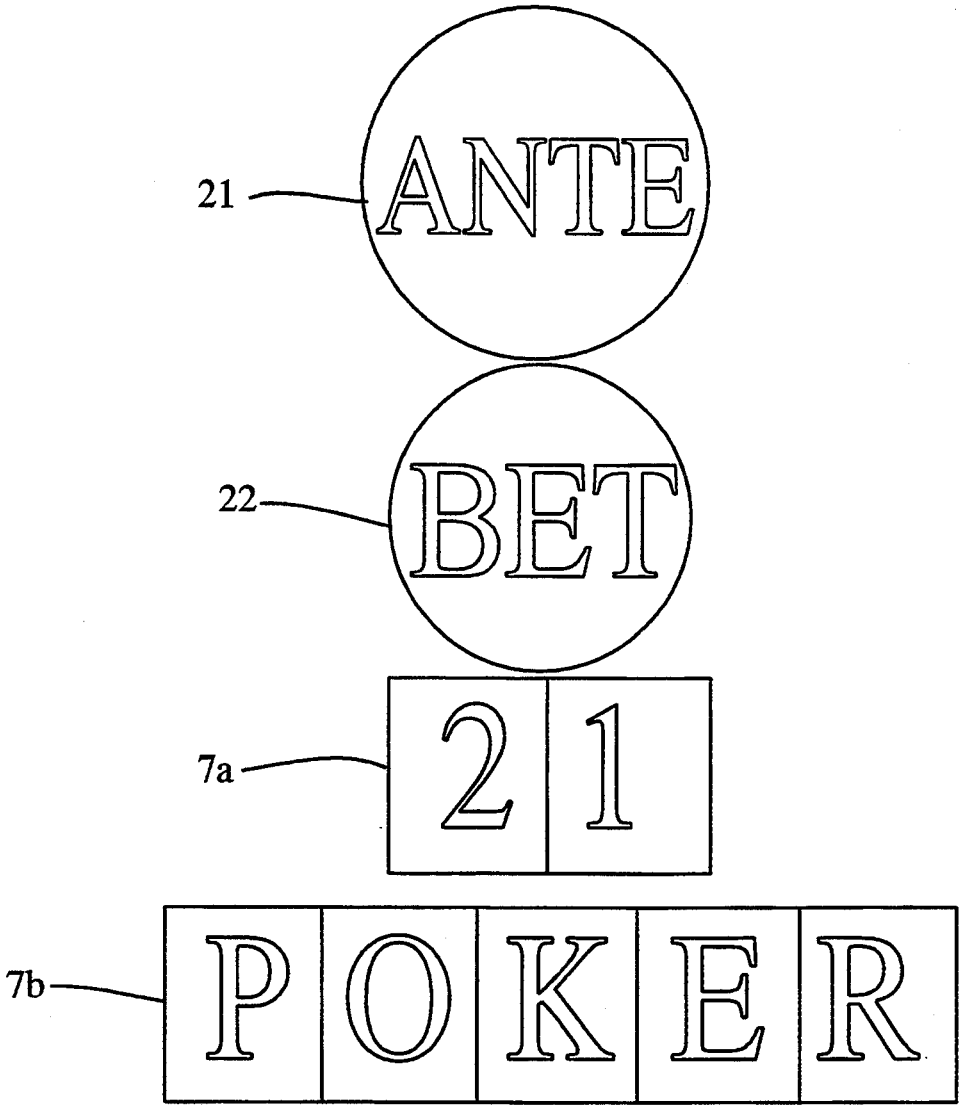
FIG. 2 shows an enlarged view of an individual player playing station in accordance with the apparatus and method of the present invention.

FIG. 2 shows an enlarged view of an individual player playing station 6 of FIG. 1A. Each player playing station 6 includes two horizontal rows of boxes *7a* and *7b*, the first (*7a*) including two boxes for Twenty-One and the second (*7b*) including five boxes for Draw Poker. Although these rows can be arranged in any order, preferably the first row of boxes is used to play Twenty-One and the second row of boxes is used to play Draw Poker. This set-up is so labeled in FIG. 2. Also arranged within each playing station is an ante area 21 and a casino or bank betting area 22 to place bets against the dealer. The dealer playing station 5 includes only the second row of five boxes provided in each player playing station.

The present invention is carried out in the following manner. The dealer begins with a deck of fifty-two cards, although a Joker can be included for use in the Draw Poker game only. The bank is always held by the casino, as is a standard practice in any commercial establishment. Conventional shuffling and cutting of the cards is carried out by the dealer before commencement of the game.

Prior to any cards being dealt, each player places his ante in the ante area 21 of his playing station 6. The ante entitles the player to receive cards to formulate a Poker hand against the dealer. At the time of placing the ante (before any cards are dealt) each player must also decide whether to place a separate Twenty-One bet against other players. If a player would like to play Twenty-One against other players, then he must place a bet in the players' bank area 20 at a position therein corresponding to his position at the table (there are six positions in the players' bank corresponding to the six player playing stations 6).

After each player places the ante in his playing station 6, and optionally places a bet in the players' bank area 20, the dealer deals five cards, face down, to each player. The dealer also takes five cards, although his first card is dealt face up, and the remaining four cards are dealt face down. Each player evaluates the five cards dealt to him and decides whether to proceed with the Draw Poker game against the dealer. If so, then the player places a bet in the casino or bank betting area 22 of his playing station 6. If the player folds, then his ante is forfeited to the casino. Any bets placed in the players' bank area 20 by a player who later folds can, at the option of that player, be removed or left for the next hand in which that player participates. If only one player places a bet in the players' bank area and that bet is not matched by at least one other player, then the player making the bet can remove it or leave it in the players' bank area 20 for the next hand. Preferably, a constant bet will be set by the casino for any bets in the players' bank area (e.g., equal to the ante for the table).

Once each player has either bet against the dealer or folded, the dealer deals two additional cards face down to all players who did not fold, and two cards to the dealer. Each participating player (and the dealer) now has a total of seven cards.

The players gather the seven dealt cards in their hands and in a timely manner, set two different hands in each of the respective two horizontal rows of boxes *7a* and *7b* in their playing station 6. More specifically, each player must take the five cards from his hand which form the strongest possible Poker hand and place those cards face down in the second horizontal row of boxes *7b*. Any player who had placed a bet in the players' bank will then place the remaining two cards face down in the first horizontal row of boxes *7a*. All players who did not place bets in the players' bank will simply discard the remaining two cards from their hand. The players hereafter can not touch their cards.

The dealer also arranges the five cards from his hand which provide the strongest Poker hand and places those cards face down in the dealer playing station 5. According to rules set by the casino, the dealer will either discard the two unused cards from his hand or set them aside to be later shown to the players. The game requires that each player evaluate his seven cards and come up with the strongest hand possible for Poker and either discard the two remaining unused cards or use them to play Twenty-One against the other players, depending upon whether the player has placed any bets in the players' bank. Again, the player can only play Twenty-One against other players who have placed bets ("second bets") in the players' bank if he himself has also initially placed a second bet in the players' bank.

After all players and the dealer have placed their cards as described above, the dealer then, perhaps with the help of an assistant, turns over each card (a total of five or seven) in its respective box in each player station 6. The dealer then turns over each one of his five cards as previously positioned by him in the dealer playing station 5.

Now the dealer compares his Poker hand against the Poker hand of each player. Determination of whose hand (between the dealer and each player independently) wins is done in accordance with traditional rules of Poker. That is, the Poker hands are ranked as follows, in descending order of strength:

Royal Flush
Straight Flush
Four of a Kind
Full House
Flush
Straight
Three of a Kind
Two Pairs
One Pair
High Card If the dealer does not have at least one-pair, then all winning bets against the dealer will be paid at 1:1. If the dealer has at least one pair, then all winning bets against the dealer will be paid as follows:

| | |
|---|---|
| One Pair | 1:1 |
| Two Pairs | 1:1 |
| Three of a Kind | 2:1 |
| Straight | 2:1 |
| Flush | 3:1 |
| Full House | 4:1 |

-continued

| | |
|---|---|
| Four of a Kind | 7:1 |
| Straight Flush | 10:1 |
| Royal Flush | 20:1 |

The ante is always paid at 1:1 to all players whose Poker hand beats that of the dealer. If any player's Poker hand equals that of the dealer, a "push" will result between that player and the dealer. Of course, all players whose Poker hands are inferior to that of the dealer will lose both their ante and their bet to the casino.

After the dealer evaluates his Poker hand against the Poker hand of each player, he settles any bets in the bank betting area 22 of each player station. That is, the dealer first settles any bets between each player and the bank. Now the dealer ceases to be a player and serves only as an administrator with regard to any second bets placed among the players themselves. That is, the dealer now compares the remaining two cards of each player who had, at the time of making their ante, placed a second bet in the players' bank 20. Those two cards will be located face down in the first horizontal row of boxes *7a* in the playing station 6 of each player who had placed a second bet in the players' bank 20. The dealer will turn over the cards in each player station and compare the hands in accordance with traditional rules of Twenty-One (i.e., closest to 21 wins). Aces are counted as eleven, face cards and tens are counted as ten, and all other cards are counted at face value. The total of all second bets placed in the players' bank will go to the player having the highest-ranking Twenty-One hand. If there is a tie, the total will be split among the players who tied. The casino could charge 5% of the total money in the players' bank as a commission for administering the Twenty-One portion of the game.

After all bets are settled between the bank and among players, the cards are collected and the game is continued as described above.

The present invention provides a novel and unique gaming method and apparatus which allows more experienced players to increase their odds against the bank and at the same time provides the bank/casino more opportunities to gain revenues from each player more rapidly. As explained above, the present invention allows players to bet against the dealer and other players simultaneously, and also combines Draw Poker and Twenty-One to allow each player to play Poker against the dealer and Twenty-One against other players simultaneously. The inventor believes that the present invention provides an exciting new parameter to casino play which has never yet been provided.

Although the present invention has been described above in detail, it is not limited to the specific embodiments described herein. Various modifications and additions may be made and will be apparent to those skilled in the art. For example, the game of Baccarat could be substituted for the Twenty-One portion of the game. Further, the present invention could be easily adapted for electronic play or as a home board game in the same manner that blackjack and other popular games have been adapted in the past. Accordingly, the invention should not be limited to the foregoing description but rather should be defined only by the following claims.

What is claimed is:

1. A method of playing a mixture of Draw Poker and Twenty-One wherein a player simultaneously plays Draw Poker against a dealer and Twenty-One against other players, comprising:

providing a playing station for each player, said playing station comprising:

i) a card playing area having a first horizontal row of two boxes and a second horizontal row of five boxes; and ii) a casino betting area positioned proximate said horizontal rows of boxes;

providing a player betting area positioned proximate said casino betting area;

at least two players making a bet in the player betting area to participate against each other in Twenty-One;

the dealer dealing five cards face down to each player and to the dealer;

at least said at least two players making a separate bet in each of their respective casino betting areas to participate against the dealer in Poker;

the dealer dealing two additional cards to each player making said separate bet, and two additional cards to the dealer;

each player assembling a Poker hand from five of their seven cards which provide the strongest possible Poker hand, and arranging those five cards face down in their respective second row of horizontal boxes;

each said at least two players assembling a Twenty-One hand from the remaining two of their seven cards and arranging those two cards face down in their respective first row of horizontal boxes;

the dealer assembling five of his seven dealt cards which provide the strongest possible Poker hand and arranging those five cards face-down in a dealer playing station;

the dealer comparing his Poker hand to that of each player, and collecting or paying said separate bet between the dealer and each player; and the dealer comparing the Twenty-One hand of each said at least two players, and settling said bets between said at least two players in the player betting area.

2. The method of claim 1, wherein the dealer uses a single fifty-two card deck.

3. The method of claim 1, wherein up to six players are participating at one time.

4. A method of simultaneously playing Draw Poker against a dealer and Twenty-One against other players, comprising the steps of:

a) at least two players making a wager to participate against each other in Twenty-One;

b) the dealer dealing five cards to each player and to the dealer;

c) at least said at least two players making a separate wager to participate against the dealer in Poker;

d) the dealer dealing two additional cards to each player making said separate wager;

e) each player and the dealer assembling a Poker hand from five of their seven cards which provide the strongest possible Poker hand;

f) each of said at least two players assembling a Twenty-One hand from the remaining two cards of their seven cards;

g) the dealer comparing his Poker hand to that of each player to settle each wager between the dealer and each player; and h) the dealer comparing the Twenty-One hand of each of said at least two players to settle the wager between said at least two players.

5. The method of claim 4, wherein the dealer uses a single fifty-two card deck.

6. The method of claim 4, wherein up to six players are participating at one time.

7. A method of playing at least one card game simultaneously against a dealer and other players, comprising the steps of:

a) at least two players making a wager to participate against each other in at least one card game;

b) the dealer dealing an appropriate number of cards to each player and to the dealer to play at least said at least one card game;

c) each player making a separate wager to participate against the dealer in at least one card game;

d) the dealer comparing his hand of cards to that of each player to settle each said separate wager between the dealer and each player; and e) the dealer comparing the hand of cards of one of said at least two players to the hand of cards of the other of said at least two players to settle said wager between said at least two players.

8. The method of claim 7, wherein said at least one game is Twenty-One.

9. The method of claim 7, wherein said at least one game is Draw Poker.

10. The method of claim 7, wherein said at least one game is Baccarat.

11. The method of claim 7, wherein each player makes said separate wager to participate against the dealer in Draw Poker, and said at least two players make said wager to participate against each other in Twenty-One.

12. The method of claim 11, wherein each player and the dealer are dealt seven cards, each player and the dealer assemble five of their seven cards which provide the strongest possible Poker hand, and said at least two players use the remaining two cards as their Twenty-One hand.

13. The method of claim 7, wherein each player first makes an ante to enter the game.

14. The method of claim 7, wherein the dealer uses a single fifty-two card deck.

15. The method of claim 7, wherein up to six players are participating at one time.

16. An apparatus for playing a mixture of Draw Poker and Twenty-One wherein a player simultaneously plays Poker against a dealer and Twenty-One against other players, said apparatus comprising:

a table having an upper playing surface;

a dealer playing station at a first position on said playing surface;

a plurality of player playing stations at spaced positions on the playing surface and opposed to said dealer playing station, each of said player playing stations comprising a first horizontal row of two boxes, a second horizontal row of five boxes and a casino betting area positioned proximate said boxes; and a player betting area positioned between said dealer playing station and the player playing stations.

17. The apparatus of claim 16, wherein said casino betting area comprises an ante betting area and a dealer betting area.

18. The apparatus of claim 16, wherein the playing surface is formed substantially in the shape of a semicircle having a substantially linear side along the diameter of the semicircle and a curved side along the circumference of the semicircle.

19. The apparatus of claim 16, wherein the dealer playing station is arranged substantially midway along the diameter of the semicircular playing surface and the player playing stations are arranged along the circumference of the semicircular playing surface and spaced an equal distance apart.

* * * * *

UNITED STATES PATENT AND TRADEMARK OFFICE

CERTIFICATE OF CORRECTION

PATENT NO. : 5,395,120

DATED : March 7, 1995

INVENTOR(S) : Mehrdad M. MALEK

It is certified that error appears in the above-indentified patent and that said Letters Patent is hereby corrected as shown below:

On the title page, item [22], change "Aug." to --Feb.--.

Signed and Sealed this

Second Day of May, 1995

Bruce Lehman

*Attest:*

BRUCE LEHMAN

*Attesting Officer*

*Commissioner of Patents and Trademarks*